US008565633B2

(12) United States Patent
Sonohara et al.

(10) Patent No.: US 8,565,633 B2
(45) Date of Patent: Oct. 22, 2013

(54) IMAGE FORMING SYSTEM, AND IMAGE FORMING METHOD

(75) Inventors: Yoshihiro Sonohara, Kanagawa (JP); Shinya Kobayashi, Kanagawa (JP); Tadashi Kasai, Kanagawa (JP); Masakazu Terao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 171 days.

(21) Appl. No.: 13/281,858

(22) Filed: Oct. 26, 2011

(65) Prior Publication Data

US 2012/0107004 A1 May 3, 2012

(30) Foreign Application Priority Data

Oct. 27, 2010 (JP) ..... 2010-240844
Oct. 6, 2011 (JP) ..... 2011-221849

(51) Int. Cl.
*G03G 15/20* (2006.01)

(52) U.S. Cl.
USPC ..... 399/69; 399/45; 399/341; 430/124.1

(58) Field of Classification Search
USPC ..... 399/69, 45, 341, 328, 329; 430/124.1, 430/124.3
See application file for complete search history.

(56) References Cited

U.S. PATENT DOCUMENTS

2009/0123204 A1* 5/2009 Ng et al. ..... 399/341
2010/0028064 A1* 2/2010 Shiozawa ..... 399/341
2010/0034569 A1* 2/2010 Moteki ..... 399/341
2011/0008086 A1* 1/2011 Matsudaira et al. ..... 399/341
2011/0206429 A1* 8/2011 Terao et al. ..... 399/341
2012/0063802 A1* 3/2012 Suzuki et al. ..... 399/341 X

FOREIGN PATENT DOCUMENTS

| | | |
|---|---|---|
| JP | 9-200551 | 7/1997 |
| JP | 10-133515 | 5/1998 |
| JP | 2001-175022 | 6/2001 |
| JP | 2002-202645 | 7/2002 |
| JP | 2005-55517 | 3/2005 |
| JP | 2008-535293 | 8/2008 |
| JP | 2009-15208 | 1/2009 |
| JP | 2011-008059 A * | 1/2011 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming system including an image forming device forming on a recording sheet a first chromatic toner image, and a second chromatic toner image having an outermost layer of transparent toner, wherein the transparent toner has lower glass transition temperature than the chromatic toners; a fixing device having a fixing member contacting the recording sheet to heat the toner images to temperature not lower than the glass transition temperature of the chromatic toners so that the toner images are fixed; and a glossing device having a glossing member contacting the recording sheet to heat the toner images to temperature not lower than the glass transition temperature of the transparent toner and lower than the glass transition temperatures of the chromatic toners so that only the transparent toner achieves a rubber state and to cool the heated first and second toner images so that the transparent toner is solidified.

10 Claims, 3 Drawing Sheets

IMAGE FORMING SYSTEM, AND IMAGE FORMING METHOD

CROSS-REFERENCE TO RELATED APPLICATIONS

This patent application is based on and claims priority pursuant to 35 U.S.C. §119 to Japanese Patent Applications Nos. 2010-240844 and 2011-221849, filed on Oct. 27, 2010, and Oct. 6, 2011, respectively, in the Japan Patent Office, the entire disclosure of which is hereby incorporated herein by reference.

FIELD OF THE INVENTION

The present invention relates to an image forming system capable of forming images having different glossiness in a recording sheet. In addition, the present invention also relates to an image forming method for forming images having different glossiness in a recording sheet.

BACKGROUND OF THE INVENTION

There is a proposal for an electrophotographic image forming apparatus capable of forming fixed toner images having different glossiness in a recording sheet. The image forming apparatus includes an image forming device to form an image including an elastic transparent toner image and a viscously flowable transparent toner image (i.e., a transparent toner image viscously flowable when heated) adjacent to the elastic transparent toner image; and a fixing device to fix the two kinds of transparent toner images on a recording sheet upon application of heat and pressure thereto. The fixing device includes a high temperature fixing device and a heat/cool fixing device. The heat/cool fixing device applies heat and pressure to the image so that the elastic transparent toner image and the viscously flowable transparent toner image have the same strain, resulting in formation of transparent images having the same glossiness after the images are fixed. In contrast, the high temperature fixing device applies heat and pressure to the image so that the elastic transparent toner image and the viscously flowable transparent toner image have different strain, resulting in formation of transparent images having different glossiness after the images are fixed. It is described in the proposal that by using this image forming apparatus, invisible images (images having low visibility) consisting of transparent toner images having the same glossiness or visible images (images having high visibility) consisting of transparent toner images having different glossiness can be formed on demand. In addition, it is described in the proposal that by treating an invisible image, which consists of transparent toner images having the same glossiness and which is obtained by the heat/cool fixing device, using the high temperature fixing device, the invisible image can be changed to a visible image.

Recently, there is a need for a technique of producing a high value added color image, which includes an image portion having a relatively low glossiness and another image portion having a relatively high glossiness, using color toners and a transparent toner or a metallic toner. When the above-mentioned image forming apparatus is used for producing such a high value added color image, the following problems are caused.

Specifically, when unfixed toner images including an elastic transparent toner image and a viscously flowable transparent toner image are fixed by the high temperature fixing device of the above-mentioned image forming apparatus, the strains stored in the elastic transparent toner image and the viscously flowable transparent toner image are different from each other. In this regard, an elastic transparent toner image surrounded by a viscously flowable transparent toner image is prevented from moving in the horizontal direction, and the surface thereof is raised to release the strain stored therein, resulting in decrease of the glossiness. Since the elastic transparent toner image has a glossiness different from that of the viscously flowable transparent toner image, a visible transparent image can be formed.

Thus, it is necessary for the image forming apparatus to use two kinds of transparent toners and to form a first transparent toner image portion formed by an elastic transparent toner and a second transparent toner image portion, which is adjacent to the first transparent toner image portion and which is formed by a viscously flowable transparent toner, so that the resultant fixed first and second toner image portions have different glossiness, thereby forming a visible transparent image. Therefore, it is not possible for the image forming apparatus to form an image, in which a transparent toner image is formed on a desired image portion of an image to differentiate the glossiness thereof from those of other image portions of the image, in a recording sheet by using only one kind of transparent toner.

It is considered that the viscously flowable transparent toner image, which prevents the elastic transparent toner image from moving in the horizontal direction, is replaced with a viscously flowable color toner to produce such a high value added image as mentioned above. However, it is necessary to surround the image area formed of the elastic transparent toner with the color toner image. Since this is a positional restriction, it is not necessarily possible to form a desired high value added image.

The purpose of the image forming apparatus mentioned above is to incorporate a transparent image having a low visibility in a print image, wherein the transparent image includes information on the print image and has small glossiness difference such that a person can only just observe the transparent image. Namely, the difference in glossiness between the transparent toner images, which is caused by the roughened surface of one of the transparent toner images, is much lower than the desired glossiness difference in a high value added image.

For these reasons, the inventors recognized that there is a need for an image forming system capable of producing a high value added color image including an image portion having a relatively high glossiness compared to other image portions.

BRIEF SUMMARY OF THE INVENTION

As an aspect of the present invention, an image forming system is provided which includes an image forming device, a fixing device and a glossing device. The image forming device forms, on a recording sheet, a first toner image including a layer of a first chromatic toner as an outermost layer, and a second toner image including a layer of a second chromatic toner and a layer of a transparent toner located on the layer of the second chromatic toner as an outermost layer, wherein the transparent toner has a lower glass transition temperature than the first and second chromatic toners. The fixing device has a fixing member to contact the first and second toner images to heat the first and second toner images to a temperature of not lower than the glass transition temperatures of the first and second chromatic toners so that the first and second toner images are fixed to the recording sheet. The glossing device has a glossing member to contact the fixed first and second toner images to heat the fixed first and second toner images to a temperature of not lower than the glass transition temperature of the transparent toner and lower than the glass transition temperatures of the first and second chromatic toners so that only the transparent toner achieves a rubber state and to cool the heated first and second toner images to a temperature lower than the glass transition temperature of the transparent toner so that the transparent toner is solidified.

As another aspect of the present invention, an image forming method is provided which includes forming on a recording sheet a first toner image including a layer of a first chromatic toner as an outermost layer, and a second toner image including a layer of a second chromatic toner and a layer of a transparent toner located on the layer of the second chromatic toner as an outermost layer, wherein the transparent toner has a lower glass transition temperature than the first and second chromatic toners; contacting a fixing member with the first and second toner images to heat the first and second toner images to a temperature of not lower than the glass transition temperatures of the first and second chromatic toners so that the first and second toner images are fixed to the recording sheet; and contacting a glossing member with the fixed first and second toner images to heat the fixed first and second toner images to a temperature of not lower than the glass transition temperature of the transparent toner and lower than the glass transition temperatures of the first and second chromatic toners so that only the transparent toner achieves a rubber state and to cool the heated first and second toner images to a temperature lower than the glass transition temperature of the transparent toner so that the transparent toner is solidified.

The aforementioned and other aspects, features and advantages will become apparent upon consideration of the following description of the preferred embodiments taken in conjunction with the accompanying drawings.

DETAILED DESCRIPTION OF THE INVENTION

A first example of the image forming system and method of the present invention will be described by reference to drawings.

Figure 1:
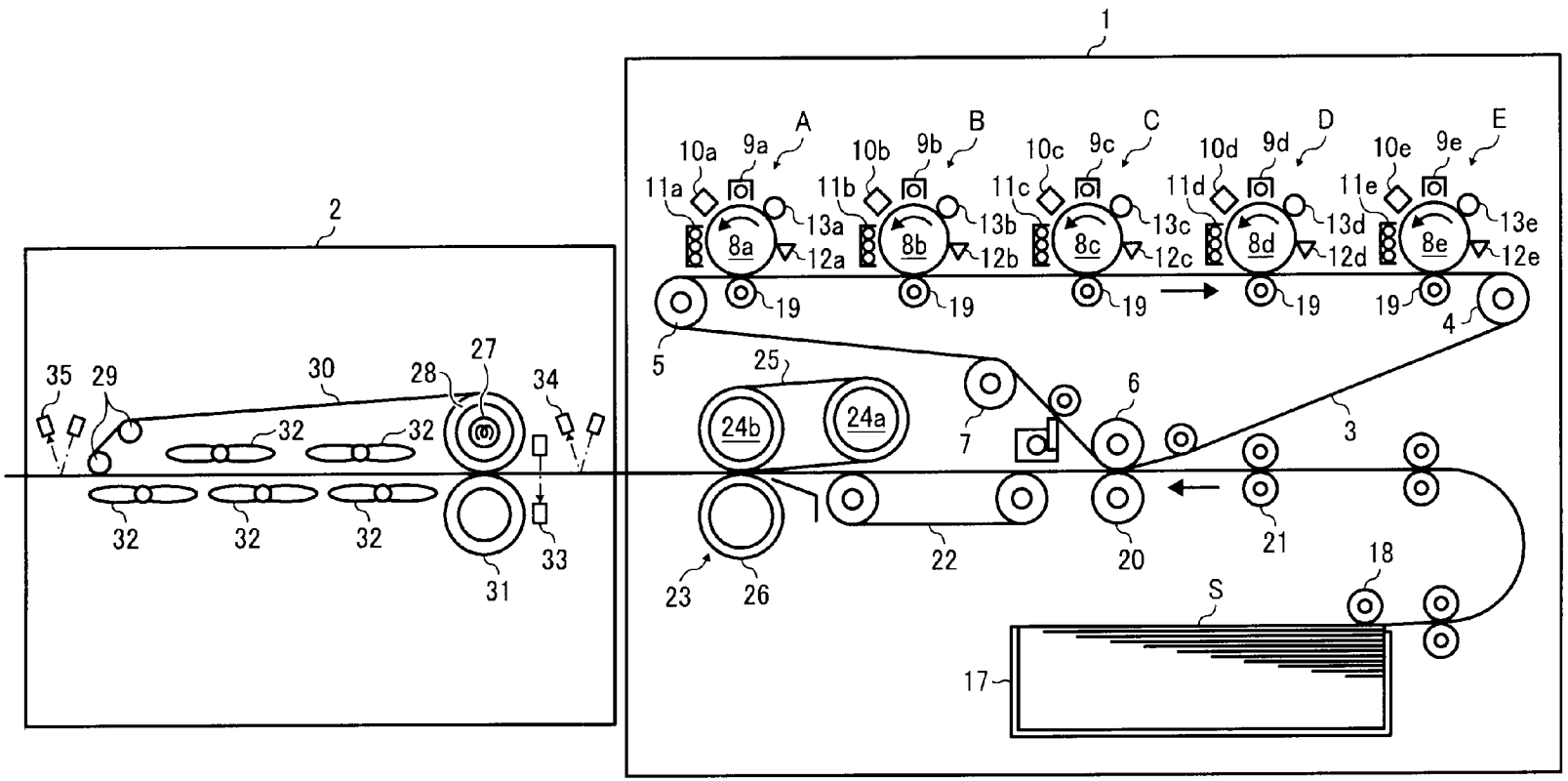
FIG. 1 is a schematic view illustrating an example of the image forming system of the present invention.

FIG. 1 illustrates an example of the image forming system of the present invention. Referring to FIG. 1, the image forming system includes an image forming apparatus 1, and a glossing device 2.

The image forming apparatus 1 includes an image forming device to form first and second toner images on a recording sheet S, and a fixing device 23 to fix the first and second toner images to the recording sheet. The image forming device includes five image forming units A-E to form a transparent toner image and four different color toner images on respective photoreceptors 8*a*-8*e*, an image data generator (illustrated in FIG. 2), a transfer device to transfer the toner images onto the recording sheet S via an intermediate transfer belt 3, and a sheet feeder to feed the recording sheet S to the transfer device from a sheet cassette 17.

The intermediate transfer belt 3 is rotated clockwise by multiple rollers including a driving roller 4, a driven roller 5, and an opposing roller 6, a tension roller 7 while tightly stretched across the rollers to bear and transport the transparent toner image and four different color toner images transferred thereon by the photoreceptors 8*a*-8*e*.

The five image forming units A-E are provided side by side along the upper portion of the intermediate transfer belt 3 supported by the driving roller 4 and the driven roller 5. The image forming unit A forms a transparent toner image on the surface of the photoreceptor 8*a*, and the image forming units B-E form yellow, cyan, magenta and black toner images on the respective photoreceptors 8*b*-8*e* using respective developers including yellow, cyan, magenta and black color toners. Hereinafter, the yellow, cyan, magenta, and black toners are sometimes referred to as chromatic toners, and the black toner is sometimes referred to as a monochromatic toner to be differentiated from the yellow, cyan and magenta toners.

The five image forming units A-E have the same configuration except that the developers (specifically, the colors of the toners therein) are different from each other.

Each of the developers is a two-component developer including a toner and a carrier. In this regard, by controlling the molecular weight or the like property of a binder resin included in each toner (for example, by decreasing the molecular weight of a binder resin included in the transparent toner so as to be relatively low compared to that of binder resins included in the chromatic toners), the glass transition temperature of the transparent toner used for the image forming unit A is lower than the glass transition temperature of each of the chromatic toners used for the image forming units B-E.

Each image forming unit includes the photoreceptor 8 (8*a*-8*e*) serving as an image bearer, a charger 9 (9*a*-9*e*) to evenly charge the peripheral surface of the photoreceptor 8, an irradiator 10 (10*a*-10*e*) to irradiate the charged photoreceptor 8 with light to form an electrostatic latent image on the photoreceptor, a developing device 11 (11*a*-11*e*) to develop the electrostatic latent image with a magnetic brush formed of a developer including a toner (i.e., the transparent, yellow, cyan, magenta or black toner) to form a toner image on the photoreceptor, a discharger 12 (12*a*-12*e*) to decay charges remaining on the surface of the photoreceptor 8 after the toner image is transferred onto the intermediate transfer belt 3, a cleaner 13 (13*a*-13*e*) to remove residual toner particles, paper dust and the like from the surface of the photoreceptor 8 after the discharging process.

Figure 2:
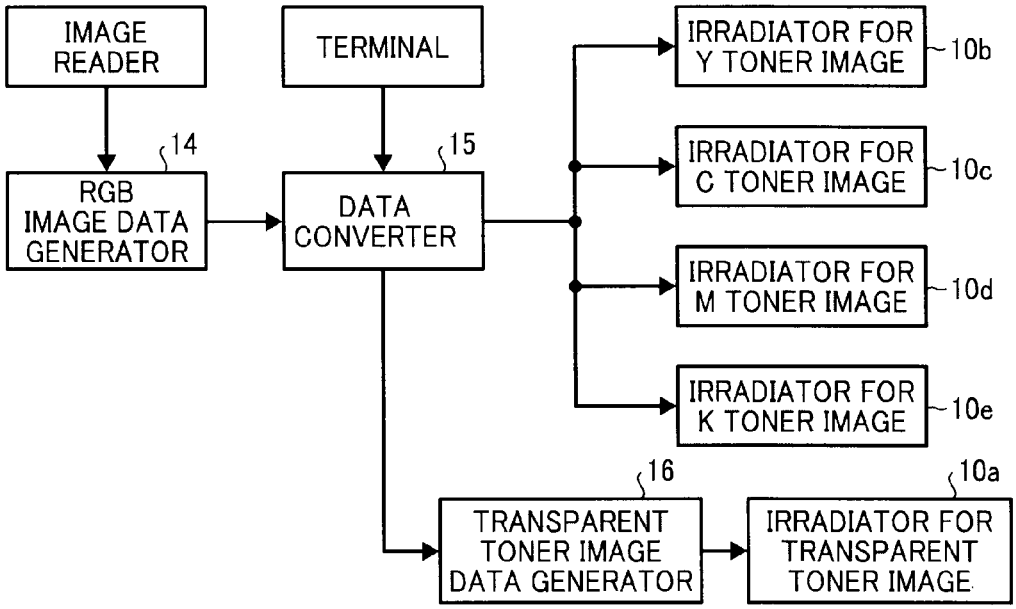
FIG. 2 is a block diagram illustrating a process of producing color image data to be sent to multiple irradiators to irradiate respective photoreceptors to form electrostatic latent images thereon.

As illustrated in FIG. 2, the image data generator includes a RGB image data generator 14, a data converter 15 to convert the RGB image data to YMCK toner image data while sending the YMCK toner image data to the respective irradiators 10*b*-10*e*, and a transparent toner image data generator 16 to generate transparent toner image data while sending the transparent toner image data to the irradiator 10*a* for transparent toner image.

The image data generating process will be described by reference to FIG. 2. In this regard, the image forming apparatus 1 is equipped with an image reader (not shown in FIG. 1) such as three line sensor type image readers and pixelization type image readers while being able to receive image data from a terminal such as computers.

Initially, the image reader of the image forming apparatus 1 optically reads an original image, and the RGB image data generator 14 generates RGB image data consisting of red (R) image data of the original image, green (G) image data of the original image, and blue (B) image data of the original image.

The data converter 15 converts the RGB image data to YMCK toner image data consisting of yellow toner image data, magenta toner image data, cyan toner image data and black toner image data to be produced. In this regard, image data are raster image data.

After converting the yellow toner image data, magenta toner image data, cyan toner image data and black toner image data to dot image data thereof, the data converter 15 sends the dot image data of the yellow, magenta, cyan and black toner images to the corresponding irradiators 10*b*, 10*d*, 10*c* and 10*e* while sending the YMCK toner image data to the transparent toner image data generator 16. In addition, the data converter 15 sends the yellow, magenta, cyan and black toner image data (raster image data) to the transparent toner image data generator 16.

When the image forming apparatus 1 receives image data consisting of yellow toner image data, magenta toner image data, cyan toner image data and black toner image data from a terminal such as computers, the data converter 15 sends dot image data corresponding to the YMCK image data to the corresponding irradiators 10 while sending the image data (raster image data) to the transparent toner image data generator 16.

Upon receipt of the YMCK image data, the transparent toner image data generator 16 obtains information on color image areas, on which a transparent toner image is to be formed, and information on monochromatic image area from the YMCK image data, and generates transparent toner image data (raster image data) based on the color image area data. In this regard, a transparent toner image is formed on the color image area in this example. After converting the transparent toner image data to dot image data thereof, the transparent toner image data generator 16 sends the dot image data to the irradiator 10*a* to form an electrostatic latent image corresponding to the transparent toner image on the corresponding photoreceptor 8*a*.

As mentioned above, in this example, a transparent toner image is formed on the color image area, and therefore the transparent toner image data are generated so as to correspond to the color image data. However, the present invention is not limited thereto, and for example, a user may designate an image area on which a transparent toner image is to be formed. In this case, the transparent toner image data generator 16 generates transparent toner image data based on the designated image area data and sends the transparent toner image data to the irradiator 10*a*. The technique of obtaining information on the transparent toner image area and other toner image areas is not particularly limited in the present application.

Referring back to FIG. 1, the sheet feeder includes the sheet cassette 17 which is located below the intermediate transfer belt 3 and in which a stack of sheets S of a recording material (such as paper sheets) are set, and a feed roller 18 to feed the stack of sheets S one by one toward the intermediate transfer belt.

The transfer device includes the intermediate transfer belt 3, primary transfer rollers 19 to primarily transfer the transparent toner image and chromatic toner images from the photoreceptors 8*a*-8*e* to the intermediate transfer belt 3 to form a combined color toner image thereon, and a secondary transfer roller 20 to transfer the combined color toner image to the recording sheet S.

The primary transfer rollers 19 are provided so as to be opposed to the respective photoreceptors 8*a*-8*e* with the intermediate transfer belt 3 therebetween, and a primary transfer bias is applied to each of the primary transfer rollers so that the toner images on the photoreceptors are satisfactorily transferred onto the intermediate transfer belt.

The secondary transfer roller 20 is provided so as to be opposed to the opposing roller 6 with the intermediate transfer belt 3 therebetween, and a secondary transfer bias is applied to the secondary transfer roller to satisfactorily transfer the combined toner image on the intermediate transfer belt 3 to the recording sheet S at a secondary transfer nip formed by the intermediate transfer belt and the secondary transfer roller. The secondary transfer roller 20 and the opposing roller 6 constitute a secondary transfer device.

The secondary transfer bias may be applied to the opposing roller 6 instead of the secondary transfer roller 20.

The sheet feeder further includes multiple rollers to feed the recording sheet fed from the sheet cassette 17 to the secondary transfer nip, a feed belt 22 to feed the recording sheet bearing the combined color toner image thereon to the fixing device 23, and a guide (not shown) to guide the recording sheet. The multiple rollers include a pair of timing rollers 21 to pinch the tip of the recording sheet S and to timely feed the recording sheet to the secondary transfer nip so that the combined color toner image on the intermediate transfer belt 3 is transferred onto a proper position of the recording sheet S.

The fixing device 23 includes a first roller 24*a* located above the rear end of the feed belt 22, a second roller 24*b* which is located on a downstream side from the first roller 24*a* relative to the sheet feeding direction and which is located on substantially the same level as the feed belt 22, an endless fixing belt 25 which is rotatable clockwise and which is heated by heaters set in the rollers 24*a* and 24*b* to heat the recording sheet S bearing the combined color toner image, and a pressure roller 26 to press the recording sheet S to the second roller 24*b*. In this regard, a fixing nip is the nip formed by the pressure roller 26 and endless fixing belt 25.

When the recording sheet S bearing the combined color toner image thereon is fed through the fixing nip, heat and pressure are applied to the recording sheet so that the combined color toner image is heated to a temperature in a predetermined fixing temperature range while receiving a pressure in a predetermined pressure range. In this regard, the predetermined fixing temperature range is the same as or narrower than a range of from a maximum temperature of the glass transition temperatures of the yellow, cyan, magenta and black toners to a minimum temperature of the melting points of the yellow, cyan, magenta and black toners. In addition, the predetermined temperature range is determined such that any one of the transparent toner and the chromatic toners does not cause an offset problem (i.e., a problem in that part of the toner image is adhered to the endless fixing belt 25) in the temperature range.

The toners constituting the combined color toner image and heated to the fixing temperature in the predetermined fixing temperature range achieve a rubber state. When the toners in the rubber state are pressed, the toners are adhered to the recording sheet S while penetrating into fibers of the recording sheet, resulting in fixation of the toner image by an anchor effect. In this regard, the glass transition temperature of the transparent toner is lower than the minimum of the glass transition temperatures of the YMCK color toners, and therefore the transparent toner image is also fixed to the recording sheet.

The glossing device 2 includes a group of rollers, a glossing belt 30, a second pressure roller 31, and cooling fans 32.

The group of rollers includes a heat roller 28 and multiple rollers 29. The heat roller 28 is rotated by a driving motor (not shown), and includes a heater 27 therein to heat the recording sheet S to a temperature in a predetermined temperature range in which only the transparent toner in the outermost layer (P3 in FIG. 3A) of the second toner image achieves a rubber state and the other toners maintain a solid state. The multiple rollers 29 are located on a downstream side from the heat roller 28 relative to the recording sheet feeding direction.

The glossing belt 30 is an endless belt rotatably supported by the group of rollers, and has an outer surface (i.e., the surface to be contacted with the recording sheet) having a higher smoothness (i.e., lower roughness) than the outer surface of the endless fixing belt 25 to be contacted with the recording sheet. The glossing belt 30 is clockwise rotated by the heat roller 28 in FIG. 1.

The second pressure roller 31 is pressed to the heat roller 28 with the glossing belt 30 therebetween so as to be driven to rotate, resulting in formation of a glossing nip.

Some of the cooling fans 32 are located on a downstream side from the second pressure roller 31 relative to the recording sheet feeding direction to supply air to the backside of the recording sheet S. The other cooling fans 32 are located in the loop of the glossing belt 30 to supply air to the backside of the glossing belt, thereby cooling the glossing belt and the toner images on the recording sheet S contacted with the glossing belt.

In the glossing device 2, the recording sheet S bearing the fixed toner image thereon is heated at the glossing nip to such a temperature that only the transparent toner in the outermost layer of the second toner image achieves a rubber state. When the recording sheet S is fed downstream after passing the glossing nip, the recording sheet S is cooled by the endless glossing belt 30, which is cooled by the cooling fans 32 in the recording sheet feeding direction, so that the temperature of the transparent toner in the outermost layer of the second toner image is decreased so as to be lower than the glass transition temperature thereof.

The treatment temperature at the glossing nip falls in a range of not lower than the glass transition temperature of the transparent toner and lower than the glass transition temperatures of the chromatic toners (i.e., YMCK toners). For example, when the glass transition temperatures of the chromatic toners fall in a range of from 63.6° C. to 65.9° C. and the glass transition temperature of the transparent toner falls in a range of from 57.2° C. to 58.1° C., the treatment temperature is not lower than 58.1° C. and lower than 63.6° C.

Each of the transparent toner and the chromatic toners used for the image forming system preferably has a hot offset temperature of not lower than 160° C. Namely, it is preferable for each toner not to cause a hot offset problem at a temperature lower than 160° C.

Next, the image forming operation of the first example of the image will be described.

As mentioned above, the transparent toner image data generator 16 obtains information on a color image area (i.e., YMC image area) and a monochromatic image area (i.e., black image area) from the YMCK toner image data sent from the data converter 15 or sent from a terminal through the data converter 15 and forms image data for the transparent toner image to be formed. As mentioned above, since the transparent toner image is formed on the YMC color image in this example, the transparent toner image area is the same as the color image area.

The data converter 15 converts the yellow, magenta, cyan and black image data to respective dot image data, and sends the dot image data to the respective irradiators 10*b*-10*e*. The transparent toner image data converter 16 converts the transparent image data to corresponding dot image data, and sends the dot image data to the developing device 10*a*.

The irradiators 10*a*-10*e* irradiate the respective photoreceptors 8*a*-8*e* according to the image data to form thereon electrostatic latent images corresponding to the transparent, yellow, cyan, magenta and black images. The thus formed electrostatic latent images are developed by the respective developing devices 11*a*-11*e*, resulting in formation of transparent, yellow, cyan, magenta and black toner images on the respective photoreceptors 8*a*-8*e*.

The thus formed transparent, yellow, cyan, magenta and black toner images are sequentially transferred onto the intermediate transfer belt 3, which is rotated clockwise in FIG. 1, by the primary transfer rollers 19 to which a transfer bias having a polarity opposite that of the charged toners is applied, resulting in formation of a combined color toner image on the intermediate transfer belt 3.

Specifically, the transparent, yellow, cyan, magenta and black toner images are primarily transferred onto the intermediate transfer belt 3 so as to be overlaid thereon. In this regard, the second toner image means color toner images which are one of yellow, cyan, and magenta images or a combination image of yellow, cyan, and magenta images and below which a transparent toner image is located, and the first toner image means a black toner image below which no transparent toner image is located.

The toner images on the intermediate transfer belt 3 are then fed toward the opposing roller 6. Meanwhile, the recording sheet S in the cassette 17 is fed toward the pair of timing rollers 21. The pair of timing rollers 21 stops once the recording sheet S by pinching the tip of the recording sheet, and then timely feeds the recording sheet toward the secondary transfer nip. The toner images on the intermediate transfer belt 3 are transferred at once onto the recording sheet S at the secondary nip by the secondary transfer roller 20 to which a transfer bias having a polarity opposite that of the charged toners is applied, resulting in formation of toner images on the recording sheet, which consist of color toner images on which the transparent toner layer is formed, and monochromatic (black) toner images. The process of forming all the toner images on the recording sheet S is the image forming step of the image forming method of the present invention.

The recording sheet S bearing the toner images is then fed to the fixing device 23. The fixing device 23 heats the toner images to a temperature not lower than (the maximum glass transition temperature of) the glass transition temperatures of the YMCK toners while applying a predetermined pressure thereto. This is the fixing step of the image forming method of the present invention. The fixed toner images are illustrated in FIG. 3A.

Figure 3A:
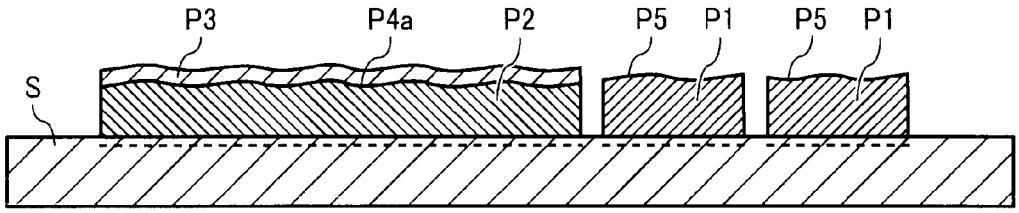
FIG. 3A is a schematic cross-sectional view illustrating a recording sheet bearing first and second toner images after toner images are fixed by a fixing device of the image forming system of the present invention.

As illustrated in FIG. 3A, the fixed toner images consist of a fixed color toner image P2 (i.e., second toner image) on which a transparent toner layer P3 is located, and a monochromatic (black) toner image P1 (i.e., first toner image) on which the transparent toner layer is not formed. As illustrated in FIG. 3A, the first and second toner images are strongly fixed to the recording sheet S while penetrating into the fibers of the recording sheet as illustrated by a dotted line.

Figure 3B:
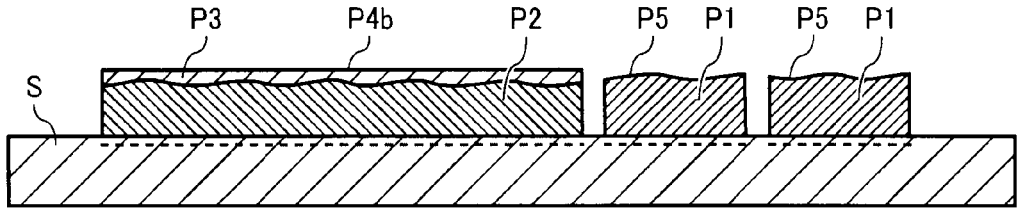
FIG. 3B is a schematic cross-sectional view illustrating the recording sheet illustrated in FIG. 3A after the fixed toner images are further subjected to a glossing treatment by a glossing device of the image forming system of the present invention.

As illustrated in FIGS. 3A, and 3B (which illustrates toner images subjected to the glossing treatment), a surface P4*a* of the fixed second toner image and a surface P5 of the fixed first toner image have a relatively low smoothness (low glossiness) compared to a surface P4*b* of the second toner image subjected to the glossing treatment. This is because the outer surface of the endless fixing belt 25 contacting the toner images has a lower smoothness than the outer surface of the endless glossing belt 30 contacting the toner images. In addition, since the toner images heated by the endless fixing belt 25 to a temperature not lower than the glass transition temperatures of the toners so as to have a rubber state are rapidly cooled after passing through the fixing device 23, the toner images are solidified while shrunk, thereby roughening the surfaces P4*a* and P5 of the first and second toner images. In general, the fixed toner images have a glossiness of not higher than 70% when the glossiness is measured by a method described in the third glossiness measuring method (Gs)(60°) in JIS Z8741 at an angle of 60°.

The recording sheet S bearing the fixed first and second toner images thereon is then fed to the glossing device 2. The glossing device 2 heats the recording sheet S to a temperature in the predetermined temperature range while applying a predetermined pressure thereto. In this case, only the transparent toner layer P3 on the second toner image P2 achieves a rubber state and the other toners maintain a solid state.

After passing the glossing nip, the toner images on the recording sheet S are moved while contacted with the endless glossing belt 30. In this case, the toner images are cooled by air supplied from the cooling fans 32 so as to have a temperature lower than the glass transition temperature of the transparent toner layer P3, and thereby the transparent toner layer P3 has the smooth surface P4*b*. In contrast, since the glass transition temperature of the first toner image P1 is higher than the temperature of the glossing nip, the first toner image does not achieve a rubber state, and thereby the smoothness (glossiness) of the surface P5 of the first toner image P1 is hardly changed. This process is the glossing step of the image forming method of the present invention.

After passing through the glossing device 2, only the surface P4 of the transparent toner layer P3 of the second toner image P2 has the smoothness corresponding to the smoothness of the outer surface of the endless glossing belt 30 contacting the toner images. For example, by using a belt having a mirror surface for the glossing belt 30, a 60-degree glossiness of not lower than 80% (i.e., substantially the same glossiness as photograph) can be imparted to the surface P4 of the transparent toner layer P3 of the second toner image P2.

The recording sheet S bearing the glossed color toner image and the non-glossed monochromatic toner image thereon is then discharged from the exit of the glossing device 2.

As described above, in the first example of the image forming system of the present invention, the image forming device forms, on a recording sheet, a toner image including a monochromatic toner image (i.e., first toner image), and a color toner image (i.e., second toner image) on which a transparent toner is present as an outermost layer, and the fixing device 23 fixes the first and second toner images to the recording sheet. Further, the glossing device 2 heats the fixed toner image to a temperature of not lower than the glass transition temperature of the transparent toner and lower than the glass transition temperatures of the other toners (chromatic toners) while applying a predetermined pressure thereto. Since only the transparent toner layer on the second toner image has a smoothness (glossiness) corresponding to the outer surface of the endless glossing belt 30 after the glossing treatment, a color image in which the color toner image (second toner image) has much higher glossiness than the monochromatic toner image (first toner image) can be produced. The position of the transparent toner layer in an image is not limited thereto, and the transparent toner layer can be formed on a desired image portion that the user designates.

Next, a second example of the image forming system of the present invention will be described.

The second example of the image forming system is a combination of the first example mentioned above and a controller to control the glossiness difference of images based on the properties (e.g., thickness and glossiness) of the recording sheet S. Hereinafter, the difference between the first example and the second example will be mainly described.

Figure 4:
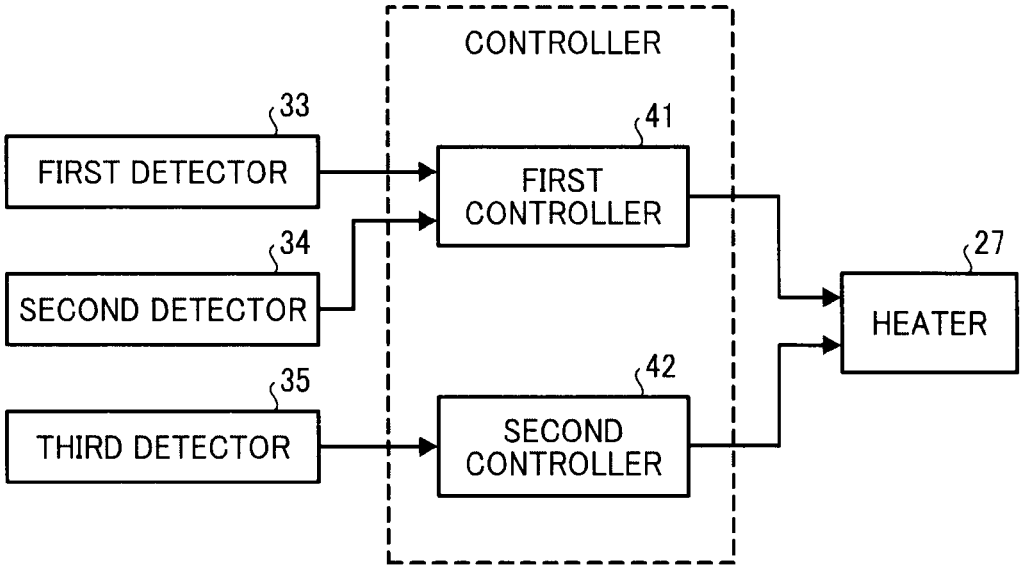
FIG. 4 is a block diagram illustrating the glossiness control operation of an example of the image forming system of the present invention.

Referring to FIGS. 1 and 4, the second example of the image forming system includes a first detector 33, a second detector 34, a third detector 35, a first controller 41, and a second controller 42.

The first detector 33 includes a transmission type photosensor provided at a position in a sheet feeding passage of from the entrance of the glossing device 2 to the glossing nip to detect information on the thickness of the recording sheet S passing through the sheet feeding passage by detecting the intensity of light passing through the recording sheet as a voltage. The first detector 33 outputs a voltage corresponding to the intensity of transmitted light to the first controller 41 as the information on the thickness of the recording sheet. This process is the first detecting step of the image forming method of the present invention. In this regard, the first detector 33 is provided at a non-image area so that the intensity of transmitted light is not affected by toner images on the recording sheet S.

The second detector 34 includes a reflection type photosensor provided at a position in a sheet feeding passage of from the entrance of the glossing device 2 to the glossing belt 30 to detect information on the glossiness of the recording sheet S by detecting the intensity of light reflected from the recording sheet. The second detector 34 outputs a voltage corresponding to the intensity of reflected light to the first controller 41 as glossiness information on the recording sheet S. This process is the second detecting step of the image forming method of the present invention. The second detector 34 is also provided at a non-image area so that the intensity of reflected light is not affected by toner images.

In this example, in order to prevent communication between the image forming apparatus 1 and the glossing device 2 concerning the information on the recording sheet, the first and second detectors 33 and 34 are provided in the glossing device 2. However, the positions of the first and second detectors 33 and 34 are not limited thereto, and the first and second detectors can be provided at any positions in a recording sheet feeding passage of from the sheet cassette 17 to the glossing nip formed by the glossing belt 30 and the second pressure roller 31. For example, when the first and second detectors 33 and 34 are provided in the vicinity of the sheet cassette 17, the limitation such that the detectors have to be provided in a non-image area is not necessary because no toner image is formed on the recording sheet at the position.

The third detector 35 includes a reflection type photosensor provided at a position in a sheet feeding passage of from the rear end of the glossing belt 30 to the exit of the glossing device 2 to detect information on the glossiness of the surface of the recording sheet bearing thereon a fixed first toner image (fixed monochromatic toner image) and a fixed and glossed second toner image (fixed and glossed color toner image having the transparent toner image as the outermost layer) by detecting the intensity of light reflected from the surface of the recording sheet. The third detector 35 sends the detected glossiness information to the second controller 42. This process is the third detecting step of the image forming method of the present invention.

For example, the third detector 35 includes multiple reflection type photo-sensors arranged at regular intervals in a direction perpendicular to the recording sheet feeding direction (i.e., the width direction of the fed recording sheet).

Next, the first controller 41 and the second controller 42 will be described. The operations thereof are also described.

The first controller 41 determines the kind of the recording sheet S based on the information on the thickness of the recording sheet (e.g., thick, medium or thin recording sheet) detected by the first detector 33, and the information on the glossiness of the recording sheet (e.g., recording sheet with high glossiness or low glossiness) detected by the second detector 34. The first controller 41 controls the temperature of the heater 27 of the heat roller 28 (i.e., the temperature in the glossing treatment) based on the thus determined kind of the recording sheet S. This process is the first control step of the image forming method of the present invention.

As mentioned above in the first example, the smoothness of the surface P4*b* of the transparent toner layer P3 on the second toner image P2 basically corresponds to that of the outer surface of the glossing belt 30. However, by changing the temperature of the glossing treatment, the smoothness can be changed to some extent. Specifically, when the treatment temperature is increased, the transparent toner changes its state from a rubber state to a liquid state, resulting in production of the self leveling effect thereof, thereby increasing the smoothness of the surface P4*b* of the transparent toner layer P3 so as to be higher than that of the outer surface of the glossing belt 30. In contrast, when the treatment temperature is decreased, the surface of the glossing belt 30 is not perfectly transferred to the surface P4*b* of the transparent toner layer P3, and the smoothness of the surface P4*b* becomes lower than that of the outer surface of the glossing belt 30.

When a thick sheet is used for the recording sheet S, the first controller increases the treatment temperature compared to a case where a medium-thickness sheet is used, because such a thick sheet typically has a relatively high heat capacity compared to such a medium-thickness sheet. In contrast, when a thin sheet is used for the recording sheet S, the first controller decreases the treatment temperature compared to the case where a medium-thickness sheet is used, because such a thin sheet typically has a relatively low heat capacity compared to such a medium-thickness sheet.

When a sheet with high glossiness is used for the recording sheet S, the first controller 41 increases the treatment temperature compared to a case where a sheet with low glossiness is used, because such a glossy sheet is considered to be a coated paper, which typically has a high heat capacity.

It is possible for the first controller 41 to change the heating time (i.e., a time in which a portion of the toner images is contacted with the glossing member) while maintaining the treatment temperature or to change both the treatment temperature and the heating time instead of changing only the treatment temperature. For example, the heating time can be changed by changing the speed of the glossing belt 30, or the pressure of the pressure roller 31 (resulting in change of the length of the glossing nip), thereby changing the heating time.

In this example, the kind of the recording sheet S is determined based on both the thickness information and the glossiness information obtained by the first and second detectors 33 and 34. However, it is possible to determine the kind of the recording sheet S based on the thickness information or the glossiness information.

The second controller 42 determines the positions of the second toner image on the recording sheet S based on the transparent toner image data generated by the transparent toner image data generator 16 and the positions of the first toner image on the recording sheet based on the monochromatic (black) image data in the YMCK toner image data generated by the data converter 15 to obtain the information on the glossiness of the surface of the second toner image and the information on the glossiness of the surface of the first toner image from the detection results of the third detector 35. The second controller 42 determines whether the difference in glossiness between the second toner image and the first toner image falls in a predetermined glossiness difference range while determining whether the glossiness of the second toner image falls in a predetermined glossiness range. If the glossiness difference and/or the glossiness of the second toner image does not fall in the predetermined range, the second controller controls the treatment temperature so that the glossiness difference and/or the glossiness of the second toner image falls in the predetermined range. This process is the second control step of the image forming method of the present invention.

The second controller 42 determines whether the difference in glossiness between the first and second toner images based on the information on the glossiness of the first and second toner images falls in a predetermined (targeted) glossiness difference range and whether the glossiness of the fixed and glossed second toner image falls in a predetermined (targeted) glossiness range. When the glossiness difference and/or the glossiness of the second toner image does not fall in the predetermined range, the second controller 42 controls the treatment temperature (and/or the heating time) so that the glossiness difference and the glossiness of the second toner image fall in the respective predetermined ranges.

Specifically, when the glossiness difference is lower than the predetermined range and the glossiness of the fixed and glossed second toner image having the transparent toner image thereon is lower than the predetermined range, the second controller increases the treatment temperature (and/or the heating time) so that the transparent toner satisfactorily achieves a rubber state.

In contrast, when the glossiness difference is lower than the predetermined range and the glossiness of the fixed and glossed second toner image having the transparent toner image thereon falls in the predetermined range, it is considered that both the first toner image and the transparent toner image on the second toner image have a rubber state, and therefore the second controller decreases the treatment temperature (and/or the heating time) so that only the transparent toner image achieves a rubber state.

The predetermined glossiness difference and the predetermined glossiness of the second toner image may be fixed values or values designated by a user.

It is preferable that one processor provided in the image forming system serves as the first and second controllers 41 and 42. In this example, an image forming apparatus and a glossing device are independently provided as illustrated in FIG. 1. In this case, a processor may be provided in each of the image forming apparatus and the glossing device so that the processors serve as the first and second controllers, or only one processor provided in the image forming apparatus or the glossing device may serve as the first and second controllers.

In addition, the kind of the recording sheet S is determined by a combination of the first and second detectors 33 and 34, and the first controller 41. However, the determination method is not limited thereto, and other methods can be used therefor.

For example, it is possible to use a sheet selection function, which general image forming apparatuses have, for determining the kind of the recording sheet S. The sheet selection function is as follows. Specifically, image forming apparatuses typically have multiple sheet cassettes. Users typically set different kinds of recording sheets to the multiple sheet cassettes. For example, a user performs a preset operation using an operation panel such that the first sheet cassette is used for postcards, the second sheet cassette is used for paper for photograph, and the third cassette is used for plain paper. In this case, when the user selects one of the cassettes, and pushes a print button, the controller performs the controlling operation based on the kind of the selected recording sheet.

In addition, the method for determining the positions of the first toner image and the second toner image is not limited to the method using the transparent toner image data generator 16 and the YMCK toner image data converter 15. For example, the positions of the first toner image and the second toner image may be determined based on the positions that the user designates.

Thus, the second example of the image forming system can produce an effect such that the desired glossiness difference between the first and second toner images and the desired glossiness of the second toner image can be securely obtained.

Hereinbefore, the image forming system of the present invention has been described by reference to the first and second examples, but is not limited thereto.

For example, the glossing device 2 is provided in the vicinity of the image forming apparatus 1 in the first and second examples, but may be provided inside the image forming apparatus 1.

In addition, in the first and second examples, the transparent toner layer P3 has a higher glossiness than the other image portions. However, the transparent toner layer P3 may have a lower glossiness than the other image portions. In this case, a unique copy can be produced.

Further, the glossiness controlling method is not limited to the method mentioned above. For example, one of a controlling method using the first detector 33 and the first controller 41, a controlling method using the second detector 34 and the first controller 41, and a controlling method using the third detector 35 and the second controller 42, and any combinations thereof can also be used.

In the above-mentioned example of the image forming system, the surface of the glossing belt 30 contacting the toner images has a higher smoothness than the surface of the fixing belt 25 contacting the toner images. However, such a smoothness limitation is not necessary as long as the difference in glossiness between the first and second toner images falls in the predetermined range, and the glossiness of the second toner image falls in the predetermined range.

Specifically, when the chromatic toner images and the transparent toner image on the recording sheet S, which have achieved a rubber state when heated at the fixing device, are cooled after passing the fixing device, the toner images are shrunk when solidified, and therefore have certain smoothnesses and glossinesses. In contrast, when the thus fixed toner images are heated by the glossing device so that only the transparent toner image has achieves a rubber state and then cooled so that the transparent toner image is solidified while contacted with the glossing member, the transparent toner image is prevented from shrinking. Therefore, even when the glossing belt and the fixing belt have substantially the same smoothness, the surface of the transparent toner image passing the glossing device has a higher smoothness than the transparent toner image (and the chromatic toner images) before passing the glossing device.

The image forming method of the present invention essentially includes the image forming step, the fixing step and the glossing step, and optionally includes the first to third detecting steps and the first and second control steps.

Additional modifications and variations of the present invention are possible in light of the above teachings. It is therefore to be understood that within the scope of the appended claims the invention may be practiced other than as specifically described herein.

What is claimed is:

1. An image forming system comprising:

an image forming device to form on a recording sheet a first toner image including a layer of a first chromatic toner as an outermost layer, and a second toner image including a layer of a second chromatic toner and a layer of a transparent toner located on the layer of the second chromatic toner as an outermost layer, wherein the transparent toner has a lower glass transition temperature than the first and second chromatic toners;

a fixing device having a fixing member to contact the first and second toner images to heat the first and second toner images to a temperature of not lower than the glass transition temperatures of the first and second chromatic toners so that the first and second toner images are fixed to the recording sheet; and a glossing device having a glossing member to contact the fixed first and second toner images to heat the fixed first and second toner images to a temperature of not lower than the glass transition temperature of the transparent toner and lower than the glass transition temperatures of the first and second chromatic toners so that only the transparent toner achieves a rubber state and to cool the heated first and second toner images to a temperature lower than the glass transition temperature of the transparent toner so that the transparent toner is solidified.

2. The image forming system according to claim 1, further comprising:

a controller to change at least one of a temperature of the glossing member and a heating time based on at least one of information on the recording sheet or information on the first and second toner images.

3. The image forming system according to claim 2, further comprising:

a detector to detect a thickness of the recording sheet as the information on the recording sheet, wherein the controller changes at least one of the temperature of the glossing member and the heating time based on the detected thickness of the recording sheet.

4. The image forming system according to claim 2, further comprising:

a detector to detect a glossiness of the recording sheet as the information on the recording sheet, wherein the controller changes at least one of the temperature of the glossing member and the heating time based on the detected glossiness of the recording sheet.

5. The image forming system according to claim 2, further comprising:

a detector to detect glossinesses of the first and second toner images heated and cooled by the glossing member as the information on the first and second toner images, wherein the controller changes at least one of the temperature of the glossing member and the heating time based on the detected glossinesses so that a difference in glossiness between the first and second toner images falls in a predetermined range, and the glossiness of the second toner image falls in a predetermined range.

6. An image forming method comprising:

forming on a recording sheet a first toner image including a layer of a first chromatic toner as an outermost layer, and a second toner image including a layer of a second chromatic toner and a layer of a transparent toner located on the layer of the second chromatic toner as an outermost layer, wherein the transparent toner has a lower glass transition temperature than the first and second chromatic toners;

contacting a fixing member with the first and second toner images to heat the first and second toner images to a temperature of not lower than the glass transition temperatures of the first and second chromatic toners so that the first and second toner images are fixed to the recording sheet; and then contacting a glossing member with the fixed first and second toner images to heat the fixed first and second toner images to a temperature of not lower than the glass transition temperature of the transparent toner and lower than the glass transition temperatures of the first and second chromatic toners so that only the transparent toner achieves a rubber state and to cool the heated first and second toner images to a temperature lower than the glass transition temperature of the transparent toner so that the transparent toner is solidified.

7. The image forming method according to claim 6, further comprising:

controlling at least one of a temperature of the glossing member and a heating time based on at least one of information on the recording sheet and information on the first and second toner images.

8. The image forming method according to claim 7, further comprising:

detecting a thickness of the recording sheet as the information on the recording sheet, and the controlling step includes:

controlling at least one of a temperature of the glossing member and a heating time based on the detected thickness of the recording sheet.

9. The image forming method according to claim 7, further comprising:

detecting a glossiness of the recording sheet as the information on the recording sheet, and the controlling step includes:

controlling at least one of a temperature of the glossing member and a heating time based on the detected glossiness of the recording sheet.

10. The image forming method according to claim 7, further comprising:

detecting glossinesses of the first and second toner images heated and cooled by the glossing member as the information on the first and second toner images, and the controlling step includes:

controlling at least one of a temperature of the glossing member and a heating time based on the detected glossinesses so that a difference in glossiness between the first and second toner images falls in a predetermined range, and the glossiness of the second toner image falls in a predetermined range.

* * * * *